US011492881B2

(12) United States Patent
Al-Shuwaikhat

(10) Patent No.: US 11,492,881 B2
(45) Date of Patent: Nov. 8, 2022

(54) OIL PRODUCTION OPTIMIZATION BY ADMIXING TWO RESERVOIRS USING A RESTRAINED DEVICE

(71) Applicant: SAUDI ARABIAN OIL COMPANY, Dhahran (SA)

(72) Inventor: Hisham I. Al-Shuwaikhat, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 90 days.

(21) Appl. No.: 17/067,166

(22) Filed: Oct. 9, 2020

(65) Prior Publication Data

US 2022/0112791 A1 Apr. 14, 2022

(51) Int. Cl.
*E21B 43/14* (2006.01)
*E21B 34/06* (2006.01)
*E21B 43/12* (2006.01)

(52) U.S. Cl.
CPC ..... *E21B 43/14* (2013.01); *E21B 34/06* (2013.01); *E21B 43/12* (2013.01)

(58) Field of Classification Search
CPC ..... E21B 43/12; E21B 43/14; E21B 34/06
See application file for complete search history.

(56) References Cited

U.S. PATENT DOCUMENTS 3,735,815 A 5/1973 Myers
6,026,904 A * 2/2000 Burd ..... E21B 43/14 166/372
2002/0050358 A1 5/2002 Algeroy et al.
(Continued)

FOREIGN PATENT DOCUMENTS

CN 201288542 Y 8/2009
CN 108150144 A 6/2018
(Continued)

OTHER PUBLICATIONS

Mohammadi, Saeed et al., "Vicsosity Reduction of Heavy Crude Oil by Dilution Methods: New Correlations for the Prediction of the Kinematic Viscosity of Blends", Chemical Engineering, Iranian Journal of Oil & Gas Science and Technology, vol. 8, No. 1, 2019, pp. 60-77 (18 pages).
(Continued)

*Primary Examiner* — George S Gray
(74) *Attorney, Agent, or Firm* — Osha Bergman Watanabe & Burton LLP

(57) ABSTRACT

A device for generating a flow of crude oil from a plurality of hydrocarbon reservoirs to a surface location, including a set of isolation devices arranged to, at least partially, hydraulically isolate a set of segments of a wellbore traversing each of the plurality of hydrocarbon reservoirs. The device further includes a trap that receives a flow of crude oil from the plurality of hydrocarbon reservoirs and generates a comingled crude oil, and a set of conduits arranged to convey the flow of crude oil from each of the plurality of hydrocarbon reservoirs to the trap, and a blending device that blends the comingled crude oil to produce a blended crude oil. The device further includes a conduit arranged to convey the comingled crude oil from the trap to the blending device, and a conduit arranged to convey the blended crude oil to the surface location.

18 Claims, 3 Drawing Sheets

(56) References Cited

U.S. PATENT DOCUMENTS

| | | | | |
|---|---|---|---|---|
| 2003/0221834 | A1 | 12/2003 | Hess et al. | |
| 2003/0226665 | A1 * | 12/2003 | Jones | E21B 17/18 166/313 |
| 2008/0017373 | A1 | 1/2008 | Jones et al. | |
| 2013/0186618 | A1 | 7/2013 | Khisamov et al. | |

FOREIGN PATENT DOCUMENTS

| | | | | |
|---|---|---|---|---|
| GB | 851096 | A | 10/1960 | |
| WO | WO-2008051830 | A2 * | 5/2008 | C10G 1/02 |

OTHER PUBLICATIONS

International Search Report and Written Opinion of the International Searching Authority issued in corresponding International Application No. PCT/US2021/053873 dated Feb. 24, 2022 (14 pages).

* cited by examiner

OIL PRODUCTION OPTIMIZATION BY ADMIXING TWO RESERVOIRS USING A RESTRAINED DEVICE

BACKGROUND

Crude oil located in the pores of a rock of a hydrocarbon reservoir can vary significantly in its physical and chemical properties from one hydrocarbon reservoir to another. These properties include vapor pressure, dissolved natural gas content, and contaminants such as sulfur, viscosity, and density, or specific gravity (SG), i.e., the ratio of the weight of equal volumes of a crude oil and pure water at standard conditions. API gravity is a commonly used index of the density of a crude oil. API stands for the American Petroleum Institute, who created this measure. Higher API indicates a lighter (lower density) crude.

In particular, different crude oils may have different API gravity and viscosity. This variation in physical properties can have a significant effect on the ease with which crude oil flows through production conduits within the wellbore to the surface, and at the surface. In particular, low API gravity and high viscosity crude oil flows much less easily than high API gravity and low viscosity crude oil through production conduits.

Consequently, low API gravity and high viscosity crude oil may require greater pumping power either at the surface or near the hydrocarbon reservoir than low density and low viscosity crude oil to force the former to the surface. Alternatively, gas may be added to the crude oil at a point in the production conduit near the hydrocarbon reservoir. This increases the API gravity and reduces viscosity of the mixture; thereby, easing flow of the mixture though the production conduit to the surface. However, this approach requires that gas be supplied to the wellbore at the surface and that additional conduits be installed within the wellbore through which gas may be pumped to the depth at which mixing with the crude oil is required. Both greater pump capacity and the addition of gas require additional energy, equipment, and cost.

Thoroughly mixing and blending two or more crude oils of different API gravity and viscosity produces a composite crude oil whose API gravity and viscosity that is intermediate between those of the component crude oils. Thus, the blended crude oil has a higher API gravity than the lowest API gravity component crude oil, and a lower API gravity than the highest density component. Similarly, the blended crude oil has a lower viscosity than the highest viscosity component crude oil, and a higher viscosity than the lowest viscosity component. The exact values of API gravity and viscosity depend on the relative volumes of the component crude oils in the blended crude oil.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments relate to a device for generating a flow of crude oil from a plurality of hydrocarbon reservoirs to a surface location, including a set of isolation devices arranged to, at least partially, hydraulically isolate a set of segments of a wellbore traversing each of the plurality of hydrocarbon reservoirs. The device further includes a trap that receives a flow of crude oil from the plurality of hydrocarbon reservoirs and generates a comingled crude oil, and a set of conduits arranged to convey the flow of crude oil from each of the plurality of hydrocarbon reservoirs to the trap, and a blending device that blends the comingled crude oil to produce a blended crude oil. The device further includes a conduit arranged to convey the comingled crude oil from the trap to the blending device, and a conduit arranged to convey the blended crude oil to the surface location.

In general, in one aspect, embodiments relate to a method for generating a flow of crude oil from a plurality of hydrocarbon reservoirs to a surface location, including at least partially, hydraulically isolating a set of segments of the wellbore traversing each of the plurality of hydrocarbon reservoirs. Further, the method includes receiving, in a trap, a flow of crude oil from the plurality of hydrocarbon reservoirs and generating a comingled crude oil; conveying, via a set of conduits, the flow of crude oil from each of the plurality of hydrocarbon reservoirs to the trap. Further, the method includes blending, in a blending device, the comingled crude oil to produce a blended crude oil and conveying it via a conduit, from the trap to the blending device; and conveying via a conduit, the blended crude oil to the surface location.

Other aspects and advantages will be apparent from the following description and appended claims.

BRIEF DESCRIPTION OF THE DRAWINGS

Throughout the figures, similar numbers are typically used for similar components.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before," "after," "single," and other such terminology. Rather, the use of ordinal numbers is to distinguish between the elements. By way of an example, a first element is distinct from a second element, and the first element may encompass more than one element and succeed (or precede) the second element in an ordering of elements.

To extract oil from a subterranean hydrocarbon reservoir a wellbore is drilled from the surface to the hydrocarbon reservoir depth. Often the wellbore will traverse multiple hydrocarbon reservoirs. Alternatively, additional wellbores may be drilled from close to the bottom of the original wellbore to access addition hydrocarbon reservoirs. As a result, it is often necessary or desirable to produce oil from multiple hydrocarbon reservoirs over at least part of the length of the wellbore to the surface through a single production conduit.

Embodiments disclosed herein describe apparatus and methods for comingling and blending crude oil from multiple hydrocarbon reservoirs to produce a composite crude oil with physical properties that are convenient for flow through the production conduit.

Figure 1:
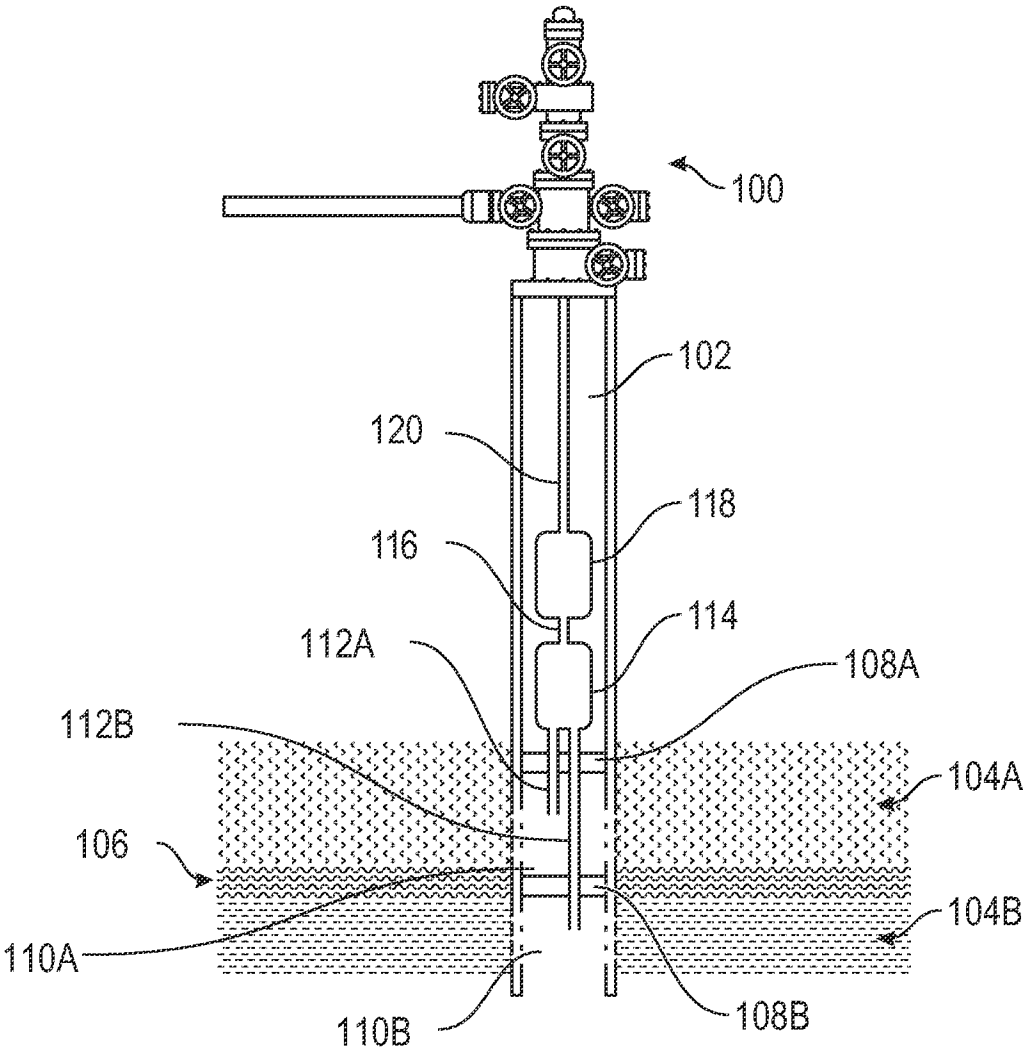
FIG. 1 depicts an apparatus in accordance with an embodiment of the invention installed in a wellbore.

FIG. 1 depicts an apparatus in accordance with an embodiment of the invention deployed in a wellbore (102), which penetrates a first hydrocarbon reservoir (104A) and a second hydrocarbon reservoir (104B). The two hydrocarbon reservoirs (104A, 104B) are separated by at least one impermeable layer (106), which prevents hydraulic communication between the hydrocarbon reservoirs (104A, 104B). Hydraulic isolation devices (108A, 108B) may be deployed in the wellbore (102) to create hydraulically isolated segments of the wellbore (110A, 110B). The hydraulically isolated segments of the wellbore (110A, 110B) comprise a segment (110A) traversing the first hydrocarbon reservoir (104A) that is hydraulically isolated from a segment (110B) of the wellbore traversing the second hydrocarbon reservoir (104B).

The hydraulic isolation devices (108A, 108B) fill the cross-section of the wellbore (102), with the exception of any conduits that may pass through it, and the hydraulic isolation devices (108A, 108B) prevent any crude oil, or other fluids, from flowing from the segment (110B) of the wellbore (102) below the hydraulic isolation device (108B) to the segment (110A) of the wellbore (102) above the hydraulic isolation device (108A), or in the reverse direction from the segment (110A) of the wellbore (102) above the hydraulic isolation device (108A) to the segment (110B) of the wellbore (102) below the hydraulic isolation device (108B). The hydraulic isolation devices (108A, 108B) may be of any type including but not limited to mechanically-set packers, tension-set packers, rotation-set packers, hydraulic-set packers, inflatable packers, permanent packers, or cement packers.

The first hydraulic isolation device (108A) may be penetrated by a first conduit (112A) through which a first crude oil may flow from the first hydrocarbon reservoir (104A) into the first hydraulically isolated segment (110A) of wellbore (102) traversing the first hydrocarbon reservoir (104A), and through the first conduit (112A) to a trap (114).

The first hydraulic isolation device (108A) may also be penetrated by a second conduit (112B) through which a second crude oil may flow from the second hydrocarbon reservoir (104B) into the second hydraulically isolated segment (110B) of wellbore (102) traversing the second hydrocarbon reservoir (104B), and through the second conduit (112B) to the trap (114).

The second hydraulic isolation device (108B) may be penetrated by the second conduit (112B). The second conduit (112B) may allow the second crude oil to flow from the second hydrocarbon reservoir (104B) to the trap (114) without mixing with first crude oil from the first hydrocarbon reservoir (104A) until both the first and second crude oil reach the trap (114).

The trap (114) collects the first crude oil from the first conduit (112A) and the second crude oil from the second conduit (112B) and comingles the first crude oil with the second crude oil. However, the trap (114) may not thoroughly blend the first crude oil and the second crude oil to form a homogeneous mixture of the first and second crude oil.

A third conduit (116) extends from the trap (114) to a blending device (118). The comingled crude oil, which comprises the first crude oil and the second crude oil, flows to the blending device (118). The comingled crude oil may flow through the third conduit (116) and enter the blending device (118). Inside the blending device (118), the combined first crude oil and second crude oil is thoroughly blended to form an intermediate crude oil, with API gravity values and viscosity values lying between the API gravity values and viscosity values of the first crude oil and the API gravity values and viscosity values of the second crude oil. The intermediate crude oil may be a homogeneous blend of the first crude oil and the second crude oil.

As a specific example, the first crude oil may have 28° API gravity, and the second crude oil may have 37° API gravity and the resulting blended crude oil may have 32° API gravity. The resulting intermediate crude oil may flow more easily, than the second crude oil with a 37° API specific gravity would flow, to the surface through a fourth conduit (120) attached to the blending device. One of ordinary skill in the art will understand that two crude oils with different API gravity values and different viscosity values than those described above, may be combined to produce a blended crude oil with API gravity, and viscosity values intermediate between those of the component crude oils.

Figure 2:
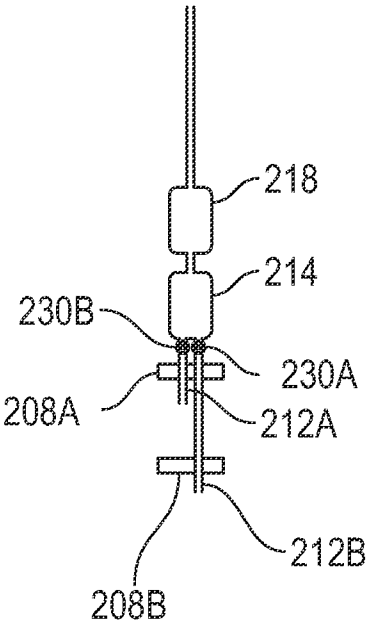
FIG. 2 depicts an apparatus in accordance with an embodiment of the invention.

FIG. 2 shows the device in accordance with another embodiment. FIG. 2 shows additional valves (230A, 203B). A first valve (230A) may be placed on the first conduit (212A) between the first hydraulic isolation device (208A) and the trap (214). A second valve (230B) may be placed on the second conduit (212B) between the first hydraulic isolation device (208A) and the trap (214). The design and manufacture of the first valve (230A) and the second valve (230B) may be identical, or the first valve (230A) and the second valve (230B) may be of different design and manufacture.

The purpose of the first valve (230A) may be to control the rate of flow of the first crude oil from the first hydrocarbon reservoir (204A). The purpose of the first valve (230A) may be to control the rate of flow of the second crude oil from the second hydrocarbon reservoir (204A). Thus, a precise amount of the first crude oil may be comingled with a precise amount of the second crude oil in the trap (214).

In accordance with some embodiments, only the first valve (230A) may form a part of the device. In accordance with some embodiments, only the second valve (230B) may form a part of the device. In accordance with some embodiments both the first valve (230A) and the second valve (230B) may be present in the device.

According to some embodiments, the valves (230A, 230B) may be opened to the desired extent manually before the embodiment is installed in the wellbore. In some embodiments, the valves may be controlled in an analogue or digital manner from the surface. In some embodiments, the valves may include flow-rate sensors and feedback electronics to control the flow-rates.

Figure 3:
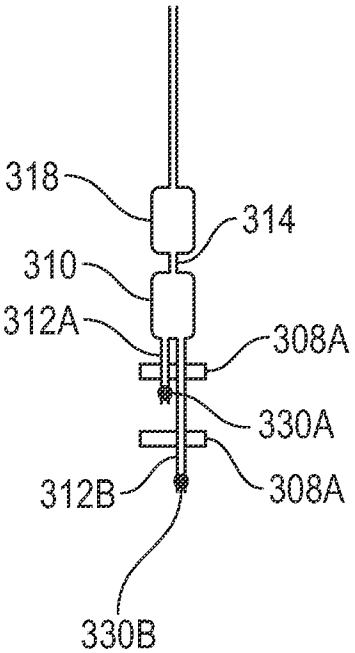
FIG. 3 depicts an apparatus in accordance with an embodiment of the invention.

FIG. 2 depicts an embodiment where the valves (230A, 230B) are positioned in the first conduit (212A) and second conduits (212B) immediately adjacent to the trap (214). However, other positions of the valves (230A, 230B) are possible. FIG. 3 depicts an embodiment where the valves (330A, 330B) are located at different positions from those shown in FIG. 2. The other elements of the device in the embodiment shown in FIG. 3 are unchanged from FIG. 2 and will not be described further. In the embodiment shown in FIG. 3, the first valve (330A) is located at the bottom of the first conduit (312A) where the first crude oil enters the first conduit (330A). The second valve (330B) is located at the bottom of the second conduit (312B) where the second crude oil enters the second conduit (330B). Other possible locations for the valves will be obvious to those of ordinary skill in the art.

Figure 4:
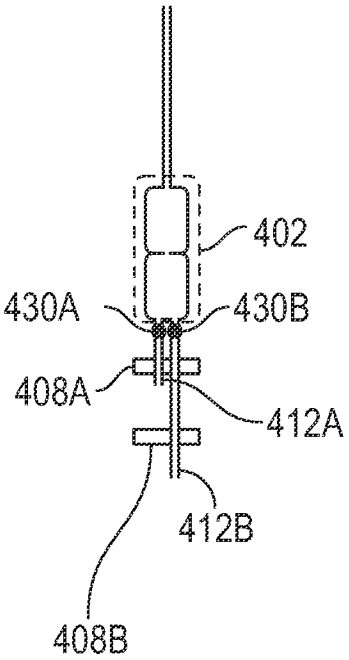
FIG. 4 depicts an apparatus in accordance with an embodiment of the invention.

In some embodiments, such as that depicted in FIG. 3, the trap (314) and the blending device (312) are connected with a third conduit (314). In some embodiments, as depicted in FIG. 4 the trap (314) and blending device (318) are connected directly to one another, or are integrated within a single housing to form a single integrated trapping and blending device (402). The integrated blending device shown in FIG. 4 has a first valve (430A) attached to a first conduit (412A) immediately adjacent to the integrated blending device (402). In addition, a second valve (430B) is attached to a second conduit (412B) immediately adjacent to the integrated blending device (402). However, it will be obvious to those of ordinary skill in the art, that the first valve (430A) may be located at other positions on the first conduit (412A), and the second valves (430B) may be positioned at other positions on the first conduit (412B) without effecting the operation of the device.

Figure 5:
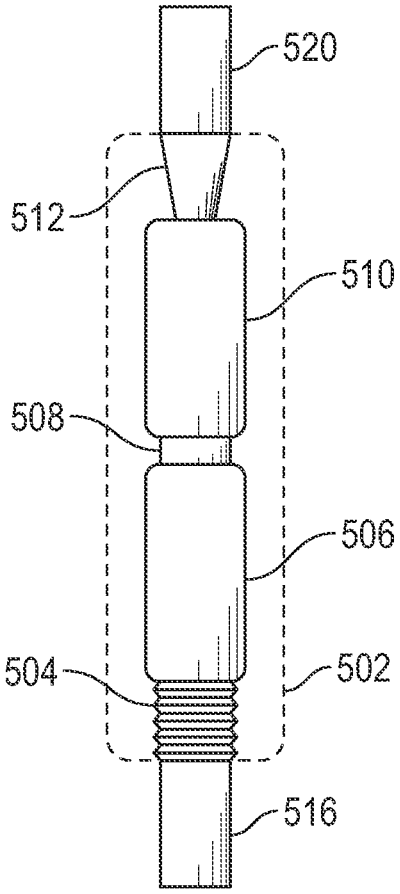
FIG. 5 depicts a restriction device in accordance with an embodiment of the invention.

FIG. 5 depicts a blending device (502) in accordance with one or more embodiments. In the embodiment shown, the blending device comprises of a viscosity actuator (504). In some embodiments, the lower end of the viscosity actuator (304) is connected to the upper end of the third conduit (514) and the upper end of the viscosity actuator (504) is connected to the lower end of a first venturi valve (506) of a first size. The upper end of the first venturi valve (506) connects via a venturi connector (508) to the lower end of a second venturi valve (510) of a second size. Finally, the upper end of the second venturi valve (510) may be attached with an upper connector (512) to a fourth conduit (520) through which the blended crude oil may flow toward the surface.

In one or more embodiments, the viscosity actuator (504) may further comprise a plurality of mesh layers through which the comingled crude oil flows to further control the viscosity of the of the comingled crude oil. In some embodiments, the plurality of mesh layers may comprise a plurality of mesh layers of varying mesh size. In some embodiments, the plurality of mesh layers of varying mesh size may comprise three mesh layers of varying mesh size.

According to one or more embodiments, the mesh size may be chosen based, at least in part, on experiment. In accordance with one or more embodiments, the mesh size may be based, at least in part, upon calculation. In still other embodiments, the mesh size may be based, at least in part, upon both experiment and calculation. In some embodiments, the mesh layers of varying mesh size may be chosen to optimally blend and modify the viscosity of a comingling of a crude oil with 37° API, and a crude oil with 28° API to generate a blended crude oil with 32° API, with a density of 0.5-0.8 cp at 140° F.

In one or more embodiments, the viscosity actuator (504) may further comprise a plurality of mesh layers through which the comingled crude oil flows to further control the viscosity of the of the comingled crude oil. In some embodiments, the plurality of mesh layers may comprise three mesh layers of varying size, wherein the size is chosen based, at least in part, on experiment. or based, in part upon calculation, or both experiment and calculation, to optimize their efficiency in controlling the viscosity of the resultant blended crude oil. In some embodiments, the mesh layers of varying size may be chosen to optimally blend and modify the viscosity of a comingling of a crude oil with 37° API, and a crude oil with 28° API to generate a blended crude oil with 32° API.

FIG. 5 shows a blending device, in accordance with one or more embodiments, which comprises a viscosity actuator and two venturi (506, 510) of different sizes. It may be understood by one of ordinary skill in the art that this may be one embodiment, but in other embodiments, there may be fewer or more than two venturi connected together above the viscosity actuator (504). The size of the venturi may be chosen based upon the anticipated velocity flow of the comingled oil and fluid properties, such as density and viscosity, of the comingle crude oil, together with the diameters of the conduits. In one or more embodiments, for comingled crude oil with 37° API, and crude oil with 28° API and a fourth conduit (520) with a diameter of 4.5 inches, a first venturi with a throat diameter of 2.0 inches and a venturi with a throat diameter of 1.6" may be chosen.

In the preceding paragraphs, the terms upper and lower have been used as a convenient method to distinguish opposite ends of several components of the blending device. The terms are not intended to imply that the device must be necessarily straight vertical with one end above, and the other end below in that straight vertical direction. The force of gravity plays no role in the operation of the blending device and the blending device would work just as effectively, if inverted or arranged at any given angle. Accordingly, those skilled in the art will readily appreciate that the terms "upper" and "lower" are not intended to be limiting.

Unless defined otherwise, all technical and scientific terms used have the same meaning as commonly understood by one of ordinary skill in the art to which these systems, apparatuses, methods, processes and compositions belong.

It is noted that one or more of the following claims utilize the term "where" or "in which" as a transitional phrase. For the purposes of defining the present technology, it is noted that this term is introduced in the claims as an open-ended transitional phrase that is used to introduce a recitation of a series of characteristics of the structure and should be interpreted in like manner as the more commonly used open-ended preamble term "comprising." For the purposes of defining the present technology, the transitional phrase "consisting of" may be introduced in the claims as a closed preamble term limiting the scope of the claims to the recited components or steps and any naturally occurring impurities. For the purposes of defining the present technology, the transitional phrase "consisting essentially of" may be introduced in the claims to limit the scope of one or more claims to the recited elements, components, materials, or method steps as well as any non-recited elements, components, materials, or method steps that do not materially affect the novel characteristics of the claimed subject matter. The transitional phrases "consisting of" and "consisting essentially of" may be interpreted to be subsets of the open-ended transitional phrases, such as "comprising" and "including," such that any use of an open ended phrase to introduce a recitation of a series of elements, components, materials, or steps should be interpreted to also disclose recitation of the series of elements, components, materials, or steps using the closed terms "consisting of" and "consisting essentially of." For example, the recitation of a composition "comprising" components A, B, and C should be interpreted as also disclosing a composition "consisting of" components A, B, and C as well as a composition "consisting essentially of" components A, B, and C. Any quantitative value expressed in the present application may be considered to include open-ended embodiments consistent with the transitional phrases "comprising" or "including" as well as closed or partially closed embodiments consistent with the transitional phrases "consisting of" and "consisting essentially of."

As used in the Specification and appended Claims, the singular forms "a", "an", and "the" include plural references unless the context clearly indicates the contrary. The verb "comprises" and its conjugated forms should be interpreted as referring to elements, components or steps in a non-exclusive manner. The referenced elements, components or steps may be present, utilized or combined with other elements, components or steps not expressly referenced.

As used here and in the appended claims, the words "comprise," "has," and "include" and all grammatical variations thereof are each intended to have an open, non-limiting meaning that does not exclude additional elements or steps.

"Optionally" means that the subsequently described event or circumstances may or may not occur. The description includes instances where the event or circumstance occurs and instances where it does not occur.

Ranges may be expressed as from about one particular value to about another particular value, inclusive. When such a range is expressed, it is to be understood that another embodiment is from the one particular value to the other particular value, along with all particular values and combinations thereof within the range.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

I claim:

1. A device for generating a flow of crude oil from a plurality of hydrocarbon reservoirs to a surface location, comprising:

a set of isolation devices arranged to, at least partially, hydraulically isolate a set of segments of a wellbore traversing each of the plurality of hydrocarbon reservoirs;

a trap that receives a flow of crude oil from each of the plurality of hydrocarbon reservoirs and generates a comingled crude oil;

a set of conduits arranged to convey the flow of crude oil from each of the plurality of hydrocarbon reservoirs to the trap;

a blending device that blends the comingled crude oil to produce a blended crude oil, wherein the blending device comprises a viscosity actuator and at least one venturi;

a conduit arranged to convey the comingled crude oil from the trap to the blending device; and a conduit arranged to convey the blended crude oil to the surface location.

2. The device of claim 1, wherein the blending device changes at least one physical property of the comingled crude oil.

3. The device of claim 2, wherein the at least one physical property is viscosity.

4. The device of claim 2, wherein the at least one physical property is API specific gravity.

5. The device of claim 1, wherein at least one conduit of the set of conduits comprises at least one valve for regulating the rate of flow from at least one of the plurality of hydrocarbon reservoirs.

6. The device of claim 1, wherein crude oil in each hydrocarbon reservoir differs in at least one physical property from crude oil in another hydrocarbon reservoir.

7. The device of claim 6, wherein the at least one physical property is viscosity.

8. The device of claim 6, wherein the at least one physical property is API specific gravity.

9. The device of claim 1, wherein the trap, the set of conduits, and blending device are integrated into a single integrated trapping and blending device.

10. A method for generating a flow of crude oil from a plurality of hydrocarbon reservoirs to a surface location, comprising:

hydraulically isolating, at least partially, a set of segments of the wellbore traversing each of the plurality of hydrocarbon reservoirs;

receiving, in a trap, a flow of crude oil from each of the plurality of hydrocarbon reservoirs and generating a comingled crude oil;

conveying, via a set of conduits, the flow of crude oil from each of the plurality of hydrocarbon reservoirs to the trap;

blending, in a blending device comprising a viscosity actuator and at least one venturi, the comingled crude oil to produce a blended crude oil;

conveying, via a conduit, the comingled crude oil from the trap to the blending device; and, conveying, via a conduit, the blended crude oil to the surface location.

11. The method of claim 10, wherein the blending changes at least one physical property of the comingled crude oil.

12. The method of claim 11, wherein the at least one physical property is viscosity.

13. The method of claim 11, wherein the at least one physical property is API specific gravity.

14. The method of claim 10, wherein at least one conduit of the set of conduits comprises at least one valve for regulating the rate of flow from at least one of the plurality of hydrocarbon reservoirs.

15. The method of claim 10, wherein crude oil in each hydrocarbon reservoir has at least one different physical property from crude oil in at least one other hydrocarbon reservoir.

16. The method of claim 15, wherein the at least one physical property is viscosity.

17. The method of claim 15, wherein the at least one physical property is density.

18. The method of claim 10, wherein the generating the comingled crude oil and the blending the comingled crude oil occur within a single integrated trapping and blending device.

* * * * *